US008060984B2

(12) United States Patent
Levermore et al.

(10) Patent No.: US 8,060,984 B2
(45) Date of Patent: Nov. 22, 2011

(54) DEVICE AND METHOD FOR IMPROVING THE INSTALLATION OF PRE-TENSIONED SPIRAL BALANCES IN WINDOW BALANCES

(75) Inventors: Curtis Levermore, Fairport, NY (US); Douglas Zinter, Rochester, NY (US)

(73) Assignee: Caldwell Manufacturing Company North America LLC, Rochester, NY (US)

( * ) Notice: Subject to any disclaimer, the term of this patent is extended or adjusted under 35 U.S.C. 154(b) by 397 days.

(21) Appl. No.: 12/392,616

(22) Filed: Feb. 25, 2009

(65) Prior Publication Data

US 2010/0212110 A1 Aug. 26, 2010

(51) Int. Cl.
*E05D 13/00* (2006.01)

(52) U.S. Cl. ..... 16/197; 49/445

(58) Field of Classification Search ..... 16/197, 16/193; 81/177.1; 52/213; 29/428; 49/181, 49/445–448

See application file for complete search history.

(56) References Cited

U.S. PATENT DOCUMENTS

| | | | | |
|---|---|---|---|---|
| 2,825,089 | A * | 3/1958 | Larson et al. | 16/197 |
| 3,070,831 | A * | 1/1963 | Larson | 16/197 |
| 4,332,054 | A * | 6/1982 | Paist et al. | 16/197 |
| 5,267,416 | A * | 12/1993 | Davis | 49/447 |
| 6,115,884 | A | 9/2000 | DeJong et al. | |
| 6,148,700 | A * | 11/2000 | Upholz | 81/486 |
| 6,948,215 | B2 | 9/2005 | Malek et al. | |
| 2010/0212463 | A1 * | 8/2010 | Kellum, III | 81/177.1 |

FOREIGN PATENT DOCUMENTS

GB 2379237 A * 3/2003

* cited by examiner

*Primary Examiner* — William L. Miller

(74) *Attorney, Agent, or Firm* — Harness, Dickey & Pierce, P.L.C.

(57) ABSTRACT

The present device is an extender for pretension spiral rod window balances. The spiral rod extender is attached to the end of the spiral rod by the window or balance manufacturer. At the window manufacturer, the sash is installed into the window frame and the balance is inserted into one of the jamb channels. A hook tool, having a hooking element at one end, is used to grab onto a hole in the end of the spiral rod to pull it a sufficient amount out of the containment tube. The hook tool manipulates the spiral rod so that a sash hook mounted on the balance engages a ledge at the end of the sash, thereby securing the balance to the sash. The spiral rod extender is then removed from the spiral rod and may be reused by the balance manufacturer or discarded as desired.

8 Claims, 9 Drawing Sheets

DEVICE AND METHOD FOR IMPROVING THE INSTALLATION OF PRE-TENSIONED SPIRAL BALANCES IN WINDOW BALANCES

FIELD OF THE INVENTION

The invention pertains to the field of windows. More particularly, the invention relates to a device and its corresponding method for installing pre-tensioned spiral balances in the jamb channels of window frames after assembly of the sash by the window manufacturer.

BACKGROUND OF THE INVENTION

Pretension spiral window balances have advantages over non-pretension balances. Pretension balances have a spiral rod that is pre-wound and set with a certain amount of tension. This saves the window manufacturer having to manually turn or wind the lift force onto the spiral rod of the balance prior to attaching the end of the spiral rod to a window sash. Pretension balances also eliminate the possibility of the window manufacturer applying an incorrect number of windings (lift force) to the balance, which could result in the improper operation or outright failure of the window balance.

When a non-pretension balance is installed into the jamb channel of a window frame, the rod is free to drop below the window sash and the rod end can be accessed for winding the lift force into the balance and then attaching it to the window sash. However, this requires specific tooling and which may be prone to human error. In a pretension balance, the lifting force is machine wound. Then the pre-wound rod is locked in position by the balance manufacturer, by means of the balance spring torque, inside a special pretension balance anchor.

After a pretension balance is mounted within the jamb channel of a window frame, the rod end may not be accessible from below the window sash because it is not free to drop below the bottom end of the sash. This makes it difficult for the window manufacturer to install the balance in the jamb channel and attach the end of the spiral rod to a ledge on the window sash.

There is a need, therefore, for a device to extend the end of the spiral rod so that the spiral rod can be pulled below the sash and secure a clip which is located at the end of the spiral rod onto a ledge on the sash. A conventional window industry balance installation tool can now be attached to the extension device and used to attach the spiral rod end to a ledge on the window sash.

SUMMARY OF THE INVENTION

The present device is a spiral rod extender. It increases the length of the end of the spiral rod in a pre-tensioned spiral rod window sash balance and is designed to facilitate the installation of the sash balance by the balance and/or window manufacturer. The spiral rod extender is attached to the end of the spiral rod by the balance manufacturer. It consists of a flattened elongated structural support member to which an elongated spring is securely attached at one end of the spring. The other end of the spring has a pin or stamped upset feature. In its resting state, the spring firmly presses against the structural support member and the pin protrudes through a hole in the structural support member. As the balance is assembled by the balance manufacturer, a pre-set amount of tension is applied to the spiral rod which retains the spiral rod in the spiral rod containment tube during shipment and handling by means of a pretension anchor contained within the closed end of the containment tube.

To install the spiral rod extender onto the end of the spiral rod, the spring and structural support member are urged apart so that the pin is withdrawn from the hole in the structural support member. The end of the spiral rod is then inserted into the end of the spiral rod extender in proximity to the separated spring and structural support member. Upon relaxing the spring, the pin at the spring's end is inserted through a hole in the spiral rod. The pin traverses through the hole in the spiral rod and continues through the hole in the structural support member, thus providing a secure fit between the spiral rod and the spiral rod extender.

At the window manufacturer's assembly facility, the sash is installed into the window frame and the balance is inserted into one of the jamb channels of the window frame. The closed end of the containment tube of the balance is securely fastened to the wall of the jamb. The sash is then urged toward the end of the secured end of the balance, exposing the spiral rod extender. The inventive hook tool is used to grab onto a hole in the end of the spiral rod extender to pull it a sufficient amount out from the containment tube to enable the window assembler to attach a retainer hook, which has been securely fastened to the spiral rod in close proximity to the end which is attached to the spiral rod extender, onto a ledge of the sash, thus securing the balance to the sash. The end of the hook is then removed from the hole in the extension device and is inserted between the structural support member and the spring to urge the pin out of the holes in the structural support member and the spiral rod. The spiral rod extender is then removed from the spiral rod and may be reused by the balance manufacturer or discarded at the option of the balance or window manufacturer.

DETAILED DESCRIPTION OF THE INVENTION

Figure 1A:
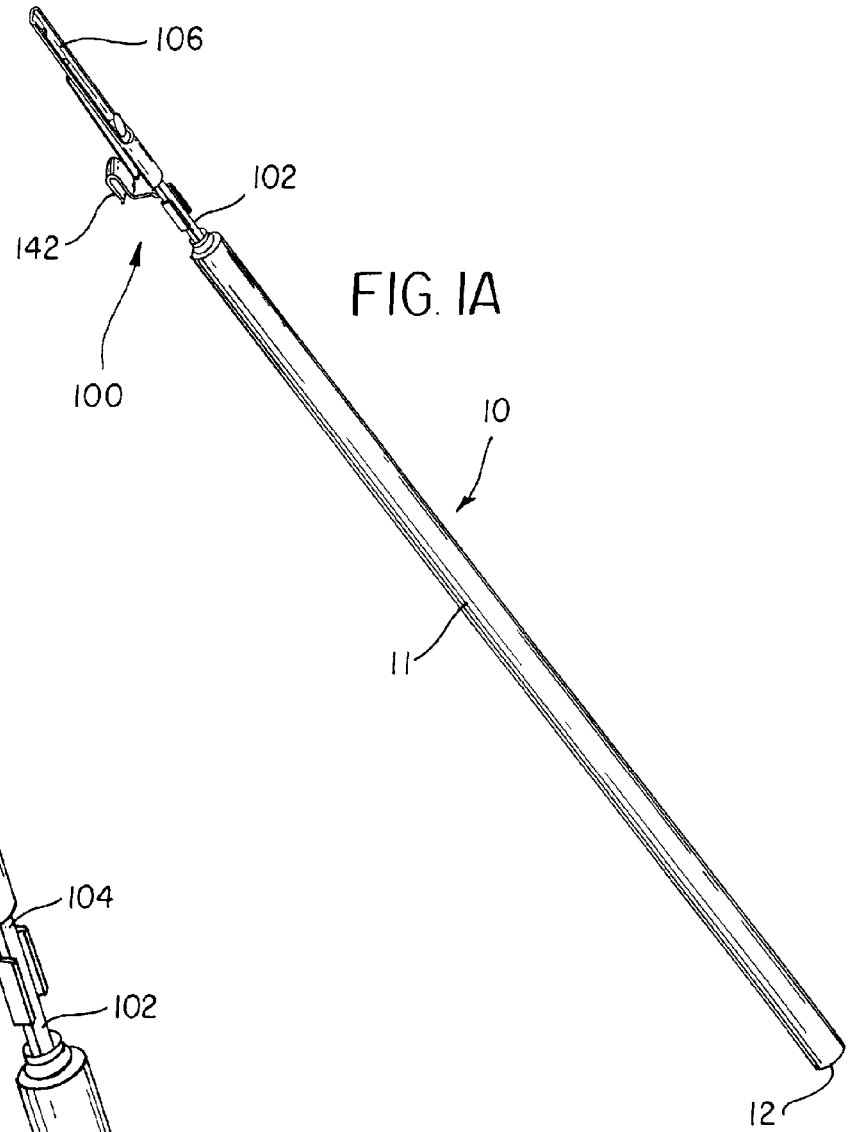
FIG. 1A shows a conventional spiral rod balance with the spiral rod extender attached.
Figure 1B:
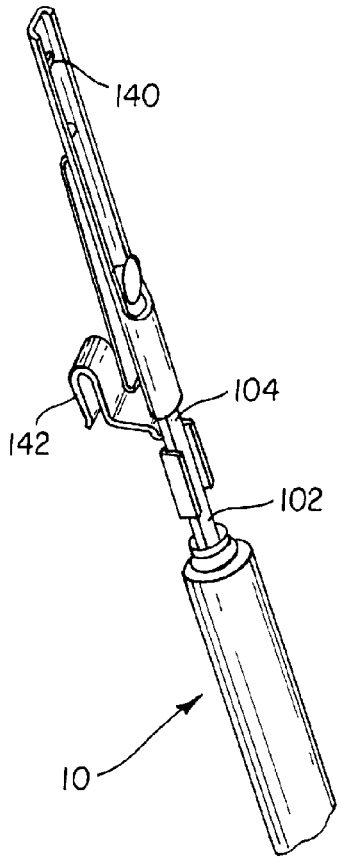
FIG. 1B shows a close up of the spiral rod extender attached to the spiral rod.
Figure 2A:
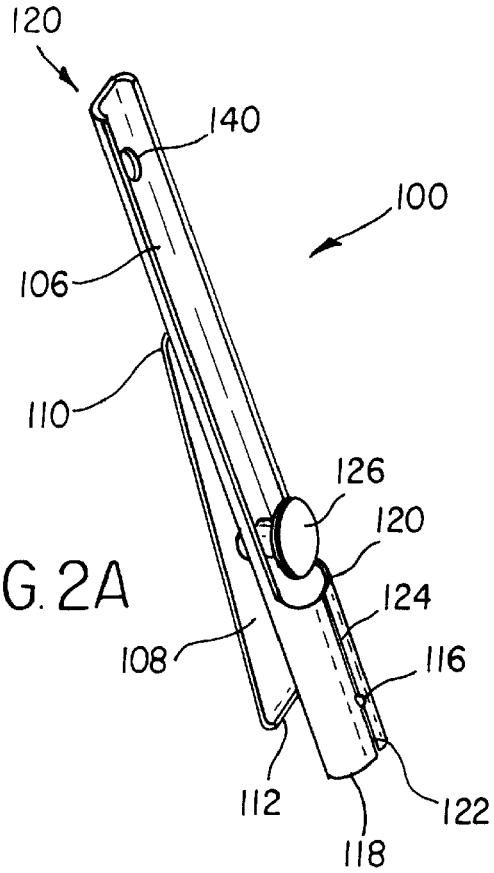
FIG. 2A shows an isometric view of the spiral rod extender.
Figure 2B:
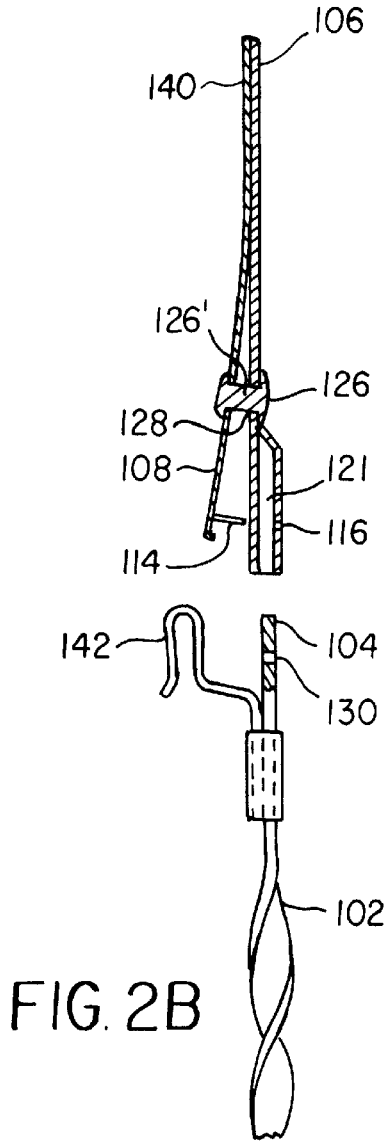
FIG. 2B shows a cross-section of the spiral rod extender through its longitudinal center-line.
Figure 3:
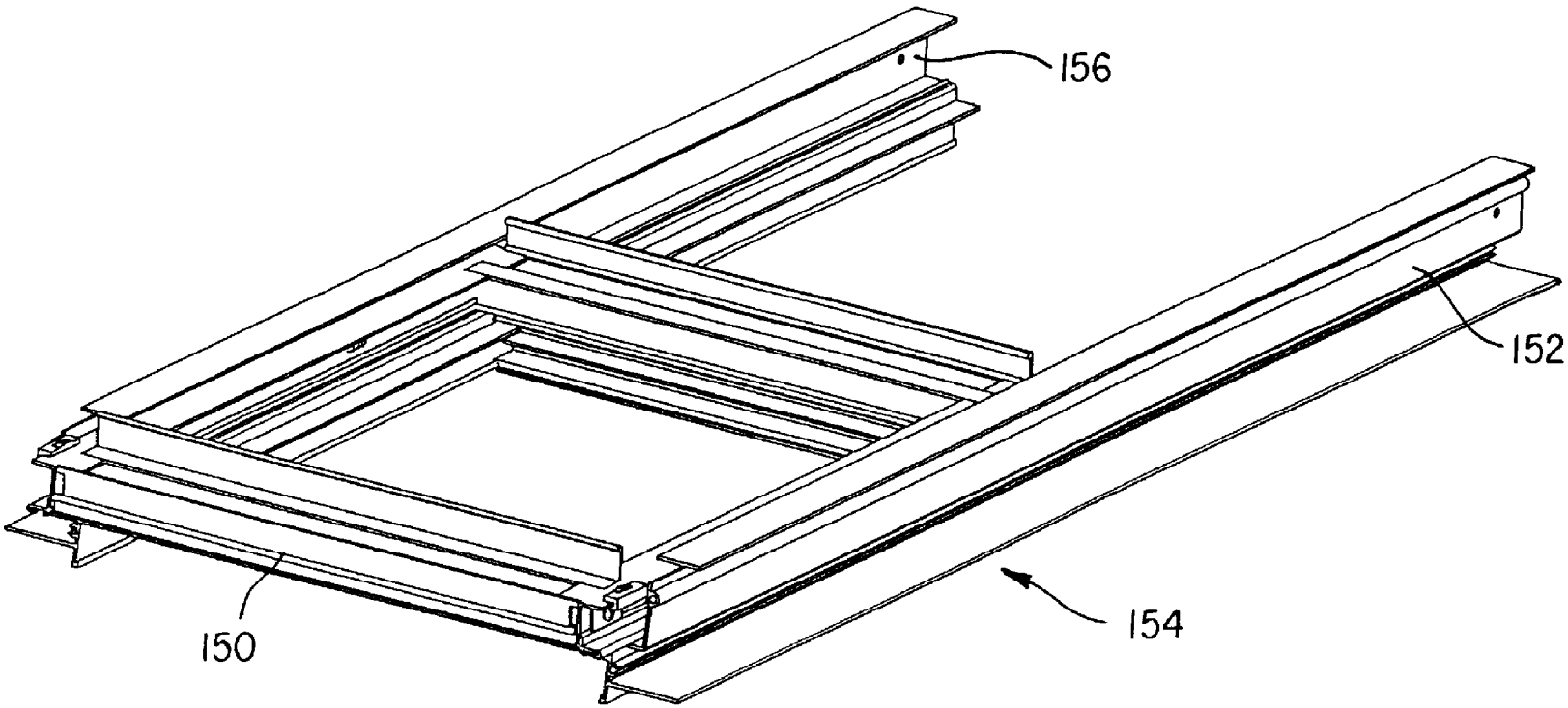
FIG. 3 shows a conventional window frame during assembly with the sash already installed between the two side window support frame members.
Figure 4:
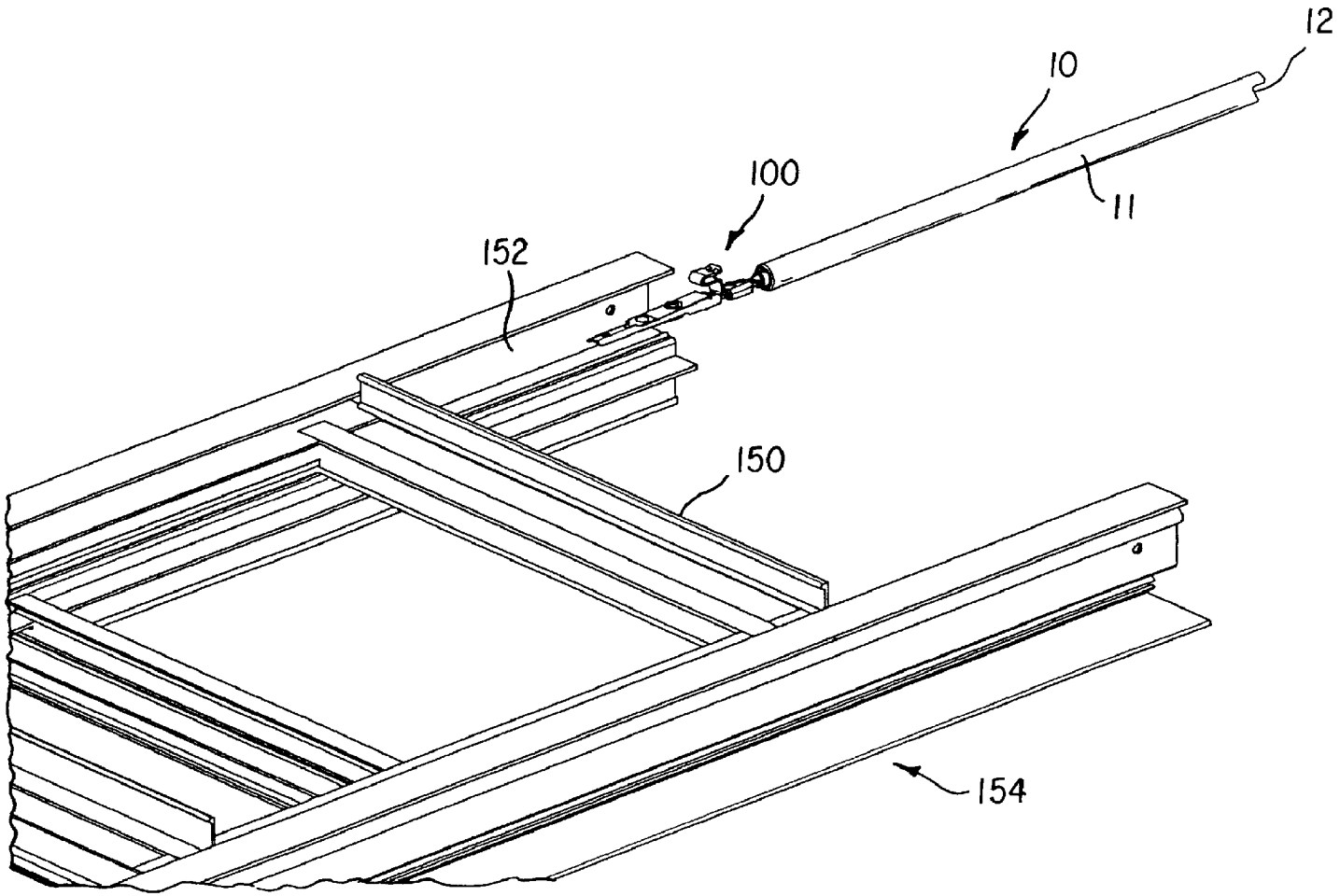
FIG. 4 shows the spiral rod balance with the spiral rod extender being oriented for installation into one of the jamb channels of the window frame.
Figure 5:
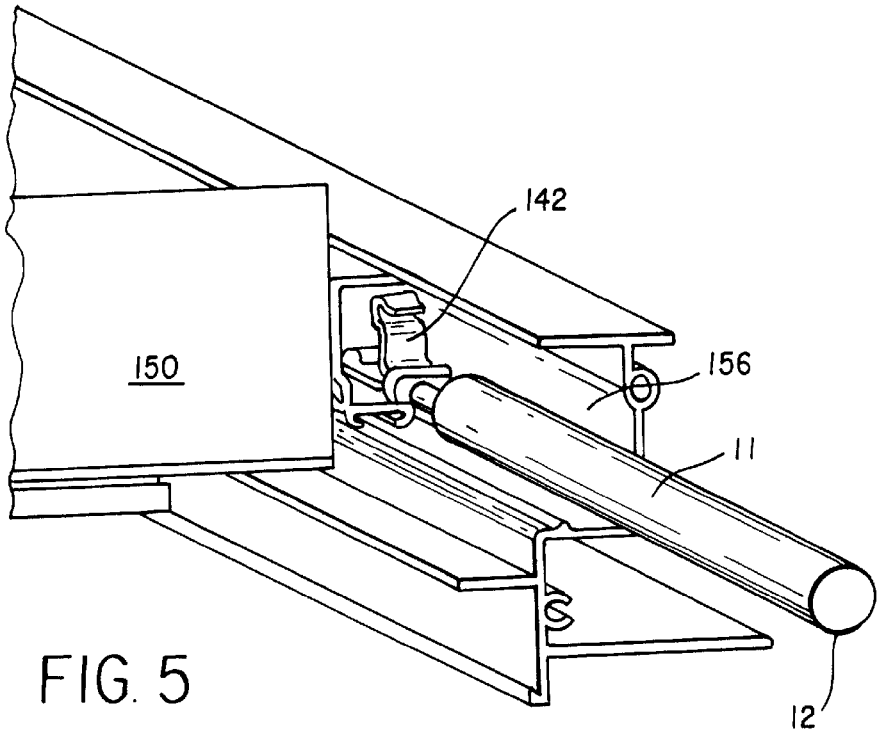
FIG. 5 shows the spiral rod balance in position to progress down the jamb channel with the spiral rod extender going in first.
Figure 6:
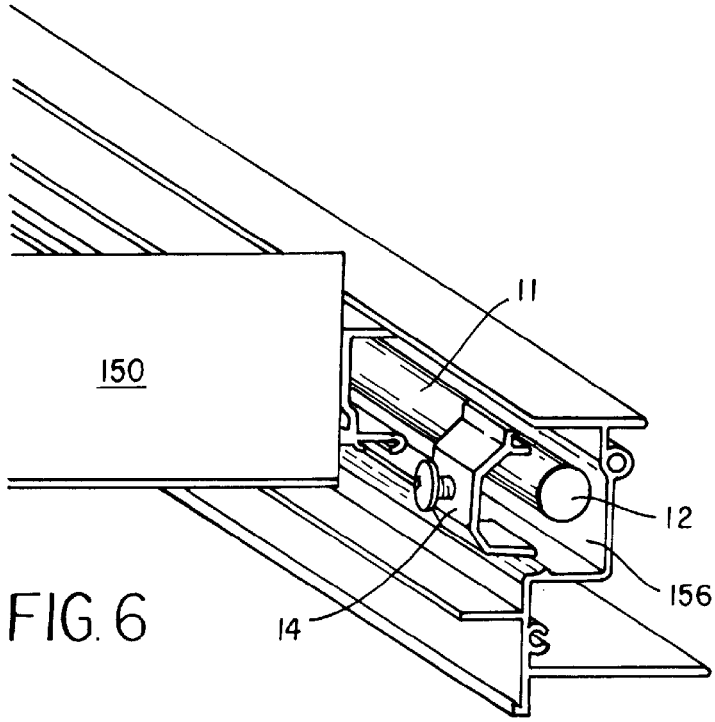
FIG. 6 shows the closed end of the containment tube of the spiral rod balance being securely fastened to the wall of the jamb channel.
Figure 7:
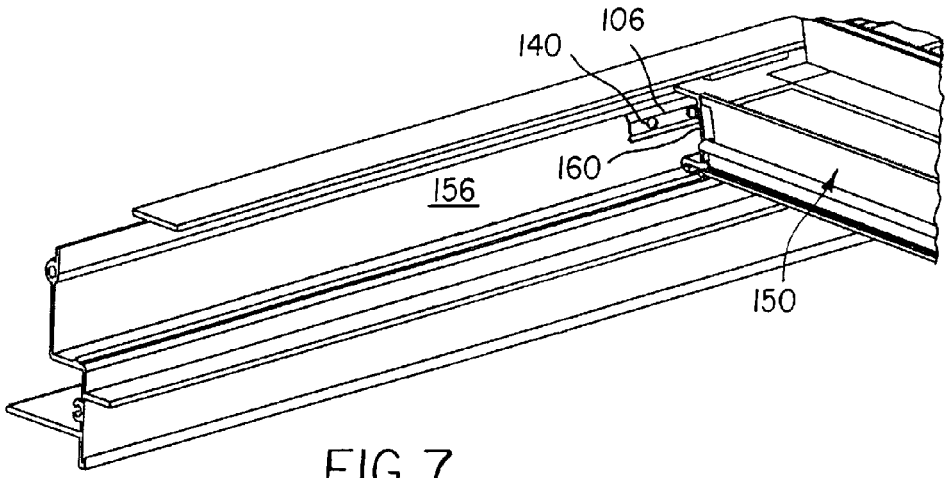
FIG. 7 shows the end of the spiral rod extender within the jamb channel with most of the spiral rod balance hidden by the sash.
Figure 8:
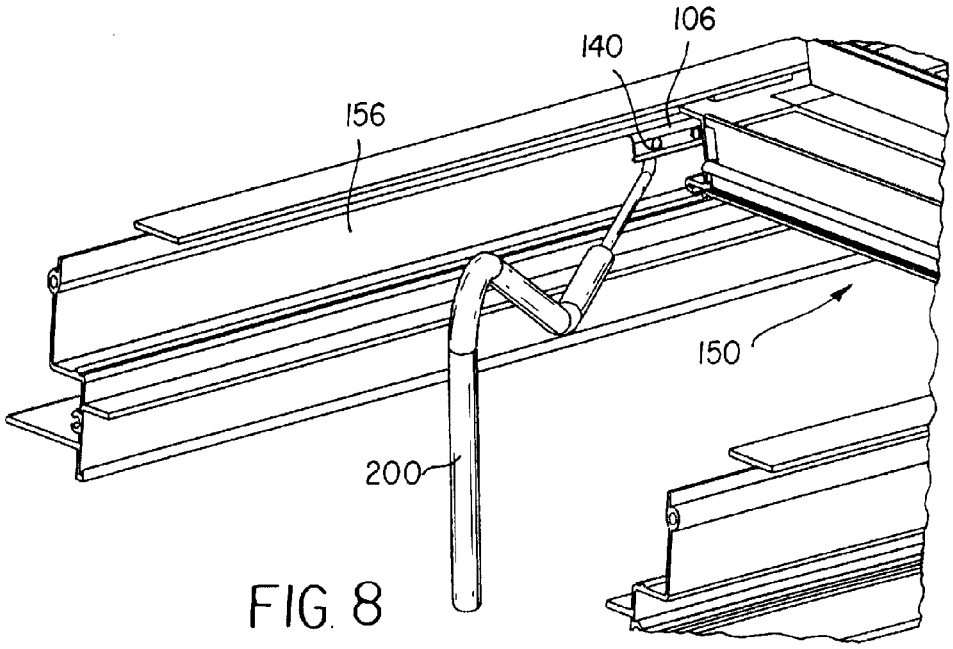
FIG. 8 shows the specially modified tool latching onto a hole in the spiral rod extender through the jamb channel.
Figure 9:
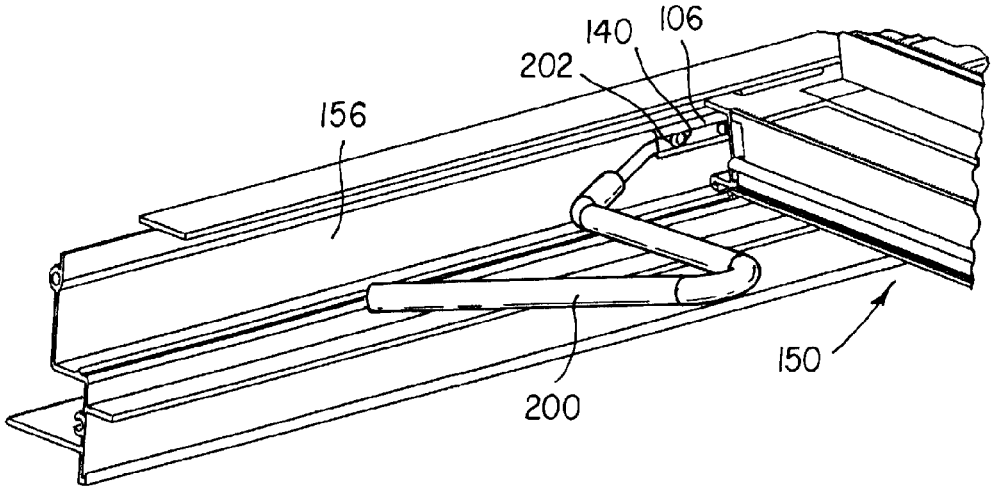
FIG. 9 shows the tool being oriented so that it may readily pull the spiral rod extender.
Figure 10:
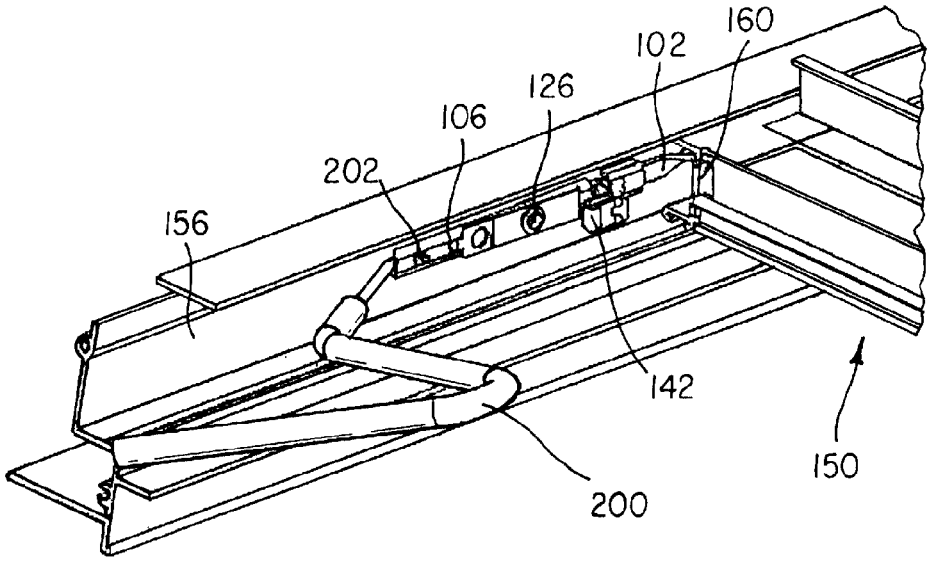
FIG. 10 shows the tool pulling the pre-tensioned spiral rod out of the containment tube, exposing the sash hook below the sash.
Figure 11:
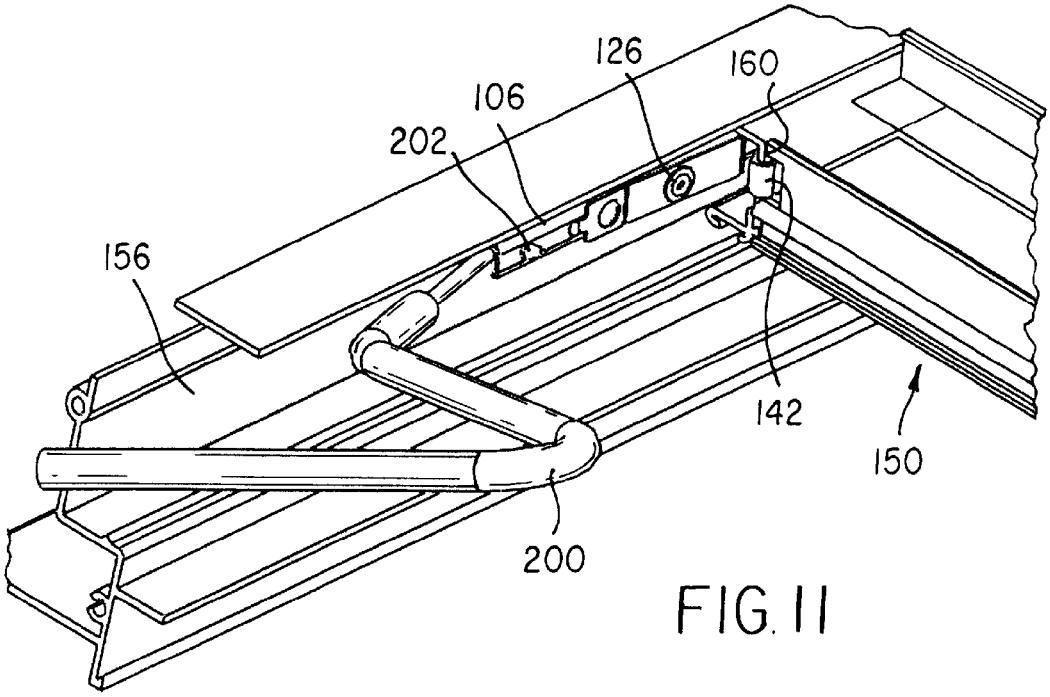
FIG. 11 shows the tool maneuvering the sash hook to connect with a mating ledge located on the sash.
Figure 12:
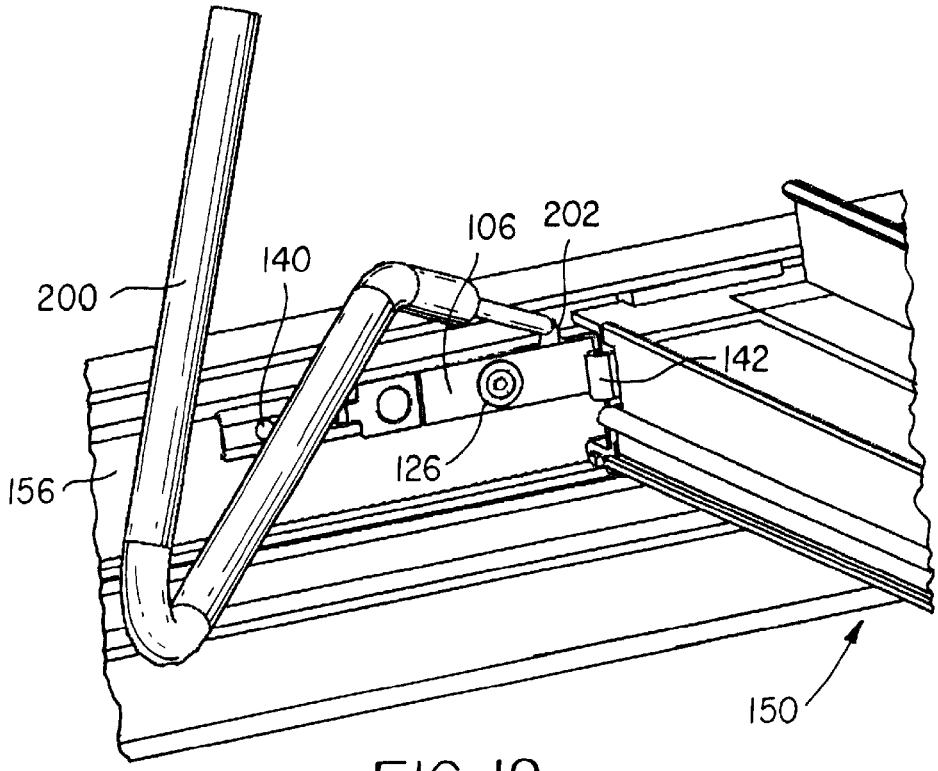
FIG. 12 shows the tip of the tool after being removed from the hole in the spiral rod extender being inserted between the spring and the structural support member of the spiral rod extender to begin the process of removing the spiral rod extender from the spiral rod.
Figure 13:
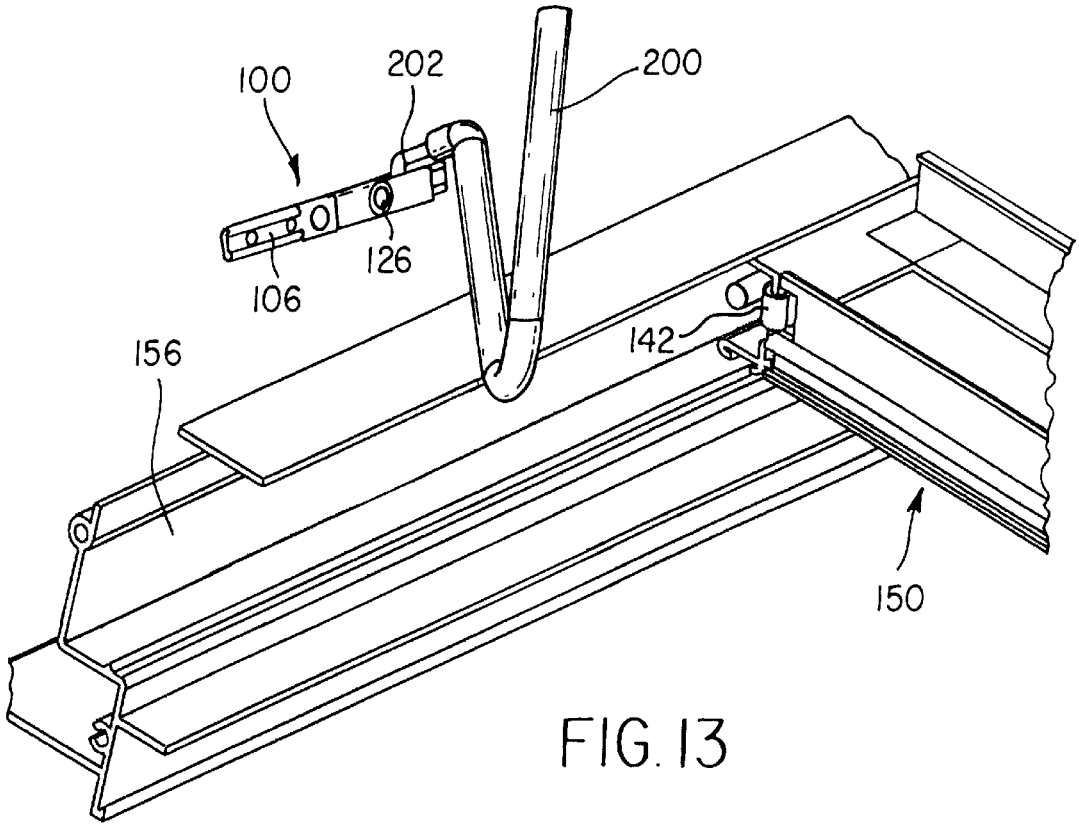
FIG. 13 shows the tool having removed the spiral rod extender from the spiral rod.

A conventional spiral rod window balance 10 is shown in FIG. 1A. The specific spiral balance shown, however, contains an extension at the end of the retractable end of the spiral rod that is referred to as the spiral rod extender 100. The end of the spiral rod 102 that extends from the containment tube is referred to herein as the first end 104 (See FIG. 1B). This spiral rod extender 100 is non-permanently secured to the first end 104 of the spiral rod 102 during assembly by the balance manufacturer or prior to installation by the window manufacturer. The first end 104 of the spiral rod has at least one hole 130 (refer to FIG. 2B) located in proximity to the first end 104 of the spiral rod 102. The spiral rod extender 100 consists of an elongated flattened structural support member 106 to which an elongated spring 108 is securely attached at the second end 110 of the spring 108. The other end, or first end 112 of spring 108 has a pin 114 or stamped upset feature. In its resting state, the spring 108 firmly presses against the structural support member 106 and the pin 114 protrudes through a hole 116 in the structural support member 106. The elongated structural member 106 has a first end 118 in proximity to the first end 112 of spring 108 and a second end 120 in proximity to the permanently fastened second end 110 of the spring 108. At rest, the elongated spring 108 lies substantially firmly against the surface of the elongated structural support member 106.

The first end 118 of the elongated structural member 106 is formed into an integral bore 121 that is designed to receive the first end 104 of spiral rod 102. The bore 121 extends only a portion down the length of the elongated structural member 106, for example, for approximately one-third to one-half of the entire length of the elongated structural member 106. The elongated structural member 106 may be fabricated from a stamped metal or metallic-like material such that enough material is retained from the stamping to allow the excess material to be folded over to form the bore 121. The two ends of the folded over excess material do not meet so that a narrow channel 124 separates them. Alternatively, the elongated structural member 106 may be manufactured from a molded material of suitable strength to survive the requirements designed for its use. A button 126, or pin having a smooth or flattened head, is located between the first and second ends of the elongated structural member 106. The shaft 126' of the button 126 extends through button hole 128 in the elongated structural member 106. The pin 114 at the first end 112 of the elongated spring 108 protrudes through a hole 116 in the elongated structural member 106 within the bore 121.

To install the extension device 100 onto the spiral rod 102, the bore 121 of the first end 118 of the elongated structural member 106 is aligned with the first end 104 of the spiral rod 102. As the spiral rod is inserted into the bore 121, the button 126 is depressed, which urges the elongated spring 108 away from abutment with the elongated structural member 106 and deflects the pin 114 out of hole 116 through the bore 121. The first end 104 of the spiral rod 102 is then able to slide unimpeded into the bore 121 until the hole 130 in the first end 104 of spiral rod 102 aligns with the hole 116 in the elongated structural member 106 and the pin 114 at the end of the elongated spring 108. As pressure is released from the button 126, the pin 114 traverses through both the hole 130 in the first end of the spiral rod 102 and the hole 116 in the elongated structural member 106, thereby non-permanently securing the spiral rod extender 100 to the spiral rod 102.

Referring to FIGS. 3-12, at the site of the window manufacturer, a sash 150 is installed into a first end 152 of a window frame 154. The end of the spiral balance 10 containing the spiral rod extender 100, is inserted into a jamb channel 156 at the first end 152 of the window frame 154 between sash 150 and outer wall of the jamb channel 156. The enclosed containment tube 11 at the second end 12 of the spiral balance 10 is securely fastened by use of a conventional fastening means 14 to the wall of the jamb channel in proximity to the first end 152 of window frame 154. The sash 150 is then urged into abutment with the first end 152 of the window frame. The spiral rod extender 100 is now exposed at the opposite end of the sash 150 in the jamb channel 156. Hook tool 200 containing hooking element 202 is inserted into the jamb channel 156 to latch onto hole 140 in proximity to the second end 120 of the elongated structural member 106. The hook tool 200 pulls the elongated structural member 106, which thereby pulls the pre-tensioned spiral rod 102, until a sash hook 142 which is securely attached in proximity to the first end 104 of the spiral rod 102 is extended beyond the end of the sash 150. The hook tool 200 then rotates the spiral rod 102 approximately 60 to 120 degrees until the sash hook 142 aligns with a ledge interface 160 on sash 150. The pre-tension force of the spiral rod 102 is then allowed to retract into the balance to securely engage sash hook 142 onto the sash ledge 160.

Once the sash hook 142 of the balance 10 is firmly engaged with the interface ledge 160 on the sash 150, the spiral rod extender 100 is no longer needed. To remove the spiral rod extender 100 from the first end 104 of the spiral rod 102, the hooking element 202 of the hook tool 200 is inserted between the elongated structural member 106 and the elongated spring 108, retracting the pin 114 at the first end 112 of the elongated spring 108 from within hole 130 in the spiral rod 102. This then allows the spiral rod extender 100 to easily slide off of the first end 104 of the spiral rod 102 and either be discarded or inventoried for return to and recycling by the window or balance manufacturer.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A spiral rod extender for use on a pretension spiral rod window balance comprising a spiral rod containment tube having a second end for fastening to a window frame and a first end and a spiral rod, the spiral rod having a first end extending from the first end of the spiral rod containment tube and a second end, the spiral rod extender comprising:

an elongated structural support member having a first end removably connected to the first end of the spiral rod and a second end and a length therebetween;

the length of the elongated structural support member being sufficient such that when the spiral rod window balance with the spiral rod extender attached to the first end of the spiral rod is located in a jamb channel of a window frame with a sash installed, and the second end of the spiral rod is in position for fastening to a wall of the jamb channel, the second end of the elongated structural support member is exposed in the jamb channel; and an elongated blade spring having a first end and a second end, the second end of the elongated blade spring permanently secured in proximity to the second end of the elongated structural support member.

2. The spiral rod extender of claim 1 wherein the first end of the elongated structural support member comprises a bore to receive the first end of the spiral rod, extending along a portion of the length of the structural support member and aligned along an axis of the spiral rod extender.

3. The spiral rod extender of claim 2 further comprising a pin at the first end of the elongated blade spring, the pin being located such that when the first end of the elongated blade spring is moved toward the first end of the elongated structural support, the pin passes through a hole in proximity to the first end of the structural support member and a hole on an outer surface of the bore.

4. The spiral rod extender of claim 3 wherein the spiral rod has a hole in proximity to the first end of the spiral rod, and when the first end of the spiral rod is inserted into the bore, the hole in the spiral rod aligns with the hole in the elongated structural support member, and the first end of the elongated blade spring is moved toward the first end of the elongated structural support, the pin passes through the hole in proximity to the first end of the structural support member, the hole in the first end of the spiral rod, and the hole on the outer surface of the bore, thereby securing the spiral rod extender to the spiral rod.

5. The spiral rod extender of claim 4, further comprising a button having a first end and a length passing through a hole in the elongated support member to a second end secured to the elongated blade spring, so that when the first end of the button is depressed toward the elongated support member, the first end of the elongated blade spring is moved away from the elongated blade member, removing the pin at least from the hole in the spiral rod and the hole in the bore, thereby releasing the spiral rod extender from the spiral rod.

6. A method for inserting a spiral rod balance into a jamb channel of a window frame after installation of a sash into the window frame, the balance comprising a spiral rod containment tube having a first end and a second end, a spiral rod within the spiral rod containment tube having a first end and a second end, and a spiral rod extender having a first end non-permanently secured to the first end of the spiral rod and a second end, the spiral rod being pretensioned with a pretension force, the method comprising the steps of:

a) inserting the first end of the spiral rod containment tube into the jamb channel;

b) urging the spiral rod containment tube through the jamb channel until the second end of the spiral rod containment tube aligns with a retention hole in a wall of the jamb channel, then securing the second end of the spiral rod containment tube to the wall of the jamb channel;

c) urging the sash toward an end of the jamb channel;

d) inserting a hooking element of a hook tool through a hole in proximity to the second end of the spiral rod extender;

e) pulling the first end of the spiral rod out of the spiral rod containment tube in opposition to the pretension force using the hook tool and rotating the spiral rod extender until a sash hook secured in proximity to the first end of the spiral rod aligns with a ledge interface on the sash;

f) allowing the spiral rod extender to retract by means of the pretension force so that the sash hook hooks onto the ledge interface of the sash; and g) manipulating the hook tool to remove the spiral rod extender from the first end of the spiral rod.

7. The method of claim 6 wherein step g) further comprises the substep of inserting the hooking element of the hook tool between an elongated structural support member of the spiral rod extender and a spring of the spiral rod extender.

8. The method of claim 7 wherein the hooking element of the hook tool urges a pin on the first end of the spiral rod extender to be removed from a hole in the structural support member, a bore on the first end of the spiral rod extender, and a hole in the first end of the spiral rod, so that the spiral rod extender is released from the spiral rod.

* * * * *